US006872878B2

(12) United States Patent
Ono et al.

(10) Patent No.: US 6,872,878 B2
(45) Date of Patent: Mar. 29, 2005

(54) MUSICAL TONE SIGNAL GENERATION APPARATUS ACCOMMODATED FOR MULTIPLE USERS PLAYING MUSIC IN ENSEMBLE

(75) Inventors: Masaharu Ono, Hamamatsu (JP); Yoshitaka Noguchi, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 117 days.

(21) Appl. No.: 09/746,391

(22) Filed: Dec. 21, 2000

(65) Prior Publication Data

US 2001/0039871 A1 Nov. 15, 2001

(30) Foreign Application Priority Data

Dec. 24, 1999 (JP) ..... 11-367129

(51) Int. Cl.[7] ..... G10H 1/00
(52) U.S. Cl. ..... 84/615; 84/653
(58) Field of Search ..... 84/615–620, 626, 84/653–658, 600, 622–625, 644, 659–661, 670, 692–700, 718–721, 470 R, 477 R, 478, DIG. 1, 94.1, 94.2, 95.1, 95.2

(56) References Cited

U.S. PATENT DOCUMENTS 4,525,878 A * 7/1985 Lowe ..... 84/94.2 X
4,920,848 A * 5/1990 Suzuki ..... 84/600
5,058,480 A * 10/1991 Suzuki et al. ..... 84/600
5,119,709 A * 6/1992 Suzuki et al. ..... 84/600
5,130,696 A * 7/1992 Liebman ..... 84/94.2 X (Continued)

FOREIGN PATENT DOCUMENTS

JP 4-240691 8/1992
JP 7-323097 12/1995
JP 10-31482 2/1998
JP 10-63264 3/1998

OTHER PUBLICATIONS

Copy of Japanese Office Action dated Mar. 2, 2004 (and English translation of relevant portion).

*Primary Examiner*—Marlon T. Fletcher
*Assistant Examiner*—David S. Warren
(74) *Attorney, Agent, or Firm*—Dickstein, Shapiro, Morin & Oshinsky, LLP.

(57) ABSTRACT

A musical tone signal generation apparatus accommodated for multiple users to play music in an ensemble is configured by a main unit and a prescribed number of performance operators, which are physically separated from each other. The main unit installs speakers that are arranged in connection with the performance operators respectively. At least one of the performance operators is configured as a hold operator that is configured using a pressure sensor mounted on a base member and encapsulated in a hold member which is made by elastic material (e.g., urethane foam) and is formed in a round shape suited for grip of the user. Each of other performance operators installs at least a pad, which is manually operated by each user to issue tone-generation instructions. Performance data (e.g., MIDI data) and tone color data are provided with respect to at least a single musical tune constructed by plural parts respectively corresponding to plural tone colors, which are automatically assigned to the performance operators. Herein, musical tone signals are automatically generated based on the performance data to play automatic performance, or musical tone signals are generated in response to tone-generation instructions being issued from the performance operator to play manual performance by the user. Moreover, the main unit installs a control panel having indicators and switches for prescribed functions and elements in music play such as play, stop, fast forward, reverse, tone volume, tempo and modulation, while the performance operator installs a sub panel having a limited number of switches.

9 Claims, 14 Drawing Sheets

U.S. PATENT DOCUMENTS 5,177,311 A * 1/1993 Suzuki et al. ..... 84/600
5,216,193 A * 6/1993 Masubuchi ..... 84/600
5,260,512 A * 11/1993 Chomette et al. ..... 84/644
5,338,891 A * 8/1994 Masubuchi et al. ..... 84/600
5,585,584 A * 12/1996 Usa ..... 84/600
5,648,626 A * 7/1997 Okamoto ..... 84/600
6,225,540 B1 * 5/2001 Fernandez et al. ..... 84/380 B

* cited by examiner

MUSICAL TONE SIGNAL GENERATION APPARATUS ACCOMMODATED FOR MULTIPLE USERS PLAYING MUSIC IN ENSEMBLE

BACKGROUND OF THE INVENTION

1. Field of the Invention

This invention relates to musical tone signal generation apparatuses that are accommodated for multiple users playing music in an ensemble. Particularly, this invention relates to electronic musical instruments accommodated for multiple users to play music in an ensemble.

2. Description of the Related Art

Conventionally, engineers propose and develop various types of musical tone signal generation apparatuses that simulate generation of sounds of acoustic musical instruments. For example, the conventional musical tone signal generation apparatuses are designed to simulate sound generation mechanisms of keyboard instruments such as pianos, wind instruments such as flutes, stringed instruments such as guitars and percussion instruments such as drums.

In general, users are required to perform prescribed manual operations on the musical tone signal generation apparatuses to issue tone-generation instructions for generation of electronic musical tones simulating sounds of the acoustic musical instruments. For example, the users play keyboards, users blow mouthpieces with designation of pitches, users pick strings with designation of pitches, and users strike surfaces of drumheads or pads.

However, it is not always easy for general users to learn and accustom themselves to the aforementioned manual operations for issuance of the tone-generation instructions on the musical tone signal generation apparatuses. Particularly, inexperienced users such as children and aged persons have difficulties in learning the manual operations of the musical tone signal generation apparatuses.

Some of the conventional musical tone signal generation apparatuses are easy to be played by the inexperienced users with simple striking operations, for example. Actually, however, a relatively large number of musical tone signal generation apparatuses are not designed to suit to handicapped persons, preschool children whose physical strengths are underdeveloped and aged persons whose physical strengths are reduced due to diseases or disorders. Hence, it is not always easy for those persons to generate tone-generation instructions of musical tone signals on the musical tone signal generation apparatuses at appropriate timings in music play.

SUMMARY OF THE INVENTION

It is an object of the invention to provide a musical tone signal generation apparatus that is accommodated for multiple users to easily participate in musical performance being played in an ensemble.

It is another object of the invention to provide a musical tone signal generation apparatus that is easy to be handled by inexperienced users such as children and aged persons to generate tone-generation instructions of musical tone signals at appropriate timings in music play.

A musical tone signal generation apparatus accommodated for multiple users to play music in an ensemble is configured by a main unit and a prescribed number of performance operators, which are physically separated from each other. The main unit installs speakers that are arranged in connection with the performance operators respectively. At least one of the performance operators is configured as a hold operator that is configured using a pressure sensor (e.g., piezoelectric sensor) mounted on a base member and encapsulated in a hold member which is made by elastic material and is formed in a round shape suited for grip of the user. Herein, the hold member is made by urethane foam, while the base member is made by glass fiber material, for example. In addition, each of other performance operators installs at least a pad, which is manually operated (or struck) by each user to issue tone-generation instructions. Performance data (e.g., MIDI data) and tone color data are provided with respect to at least a single musical tune constructed by plural parts respectively corresponding to plural tone colors, which are automatically assigned to the performance operators. The performance data and tone color data are provided from a floppy disk being inserted into a floppy disk drive of the main unit, or they are downloaded from a server by way of a communication network, for example.

In case of automatic performance, musical tone signals are automatically generated based on the performance data, so that the speakers of the main unit produce corresponding musical tones. In case of manual performance, the users strike the pads of the performance operators to issue tone-generation instructions, or the user holds the hold operator with his/her hand so that tone-generation instructions are issued in response to an intensity of pressure detected by the pressure sensor or its differential values. That is, musical tone signals are generated in response to the tone-generation instructions being issued from the performance operator manually operated by the user, so that the speaker produces corresponding musical tones with respect to its tone color. Herein, it is possible to produce accompaniment sounds together with the musical tones of the manual performance.

For controls of the automatic performance and manual performance, the main unit installs a control panel that has indicators and switches for prescribed functions in music play such as play, stop, fast forward and reverse as well as controls for prescribed elements in generation of musical tones such as tone volume, tempo and modulation. In addition, it is possible to additionally install a sub panel on a selected performance operator to provide prescribed switches and controls. Further, each of the performance operators installs an informer such as a speaker and a light emitter to inform the user of issuance of the tone-generation instructions by sound or light.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in further detail by way of examples with reference to the accompanying drawings.

[A] Hardware and Electronic Configuration

The preferred embodiment of this invention describes an example of a musical tone signal generation apparatus that is designed as a "transportable" electronic musical instrument. Appearance and hardware of the electronic musical instrument will be described with reference to FIGS. 1 to 6, then, an electronic configuration will be described with reference to FIGS. 7 to 10.

(1) Appearance and Hardware

Figure 1:
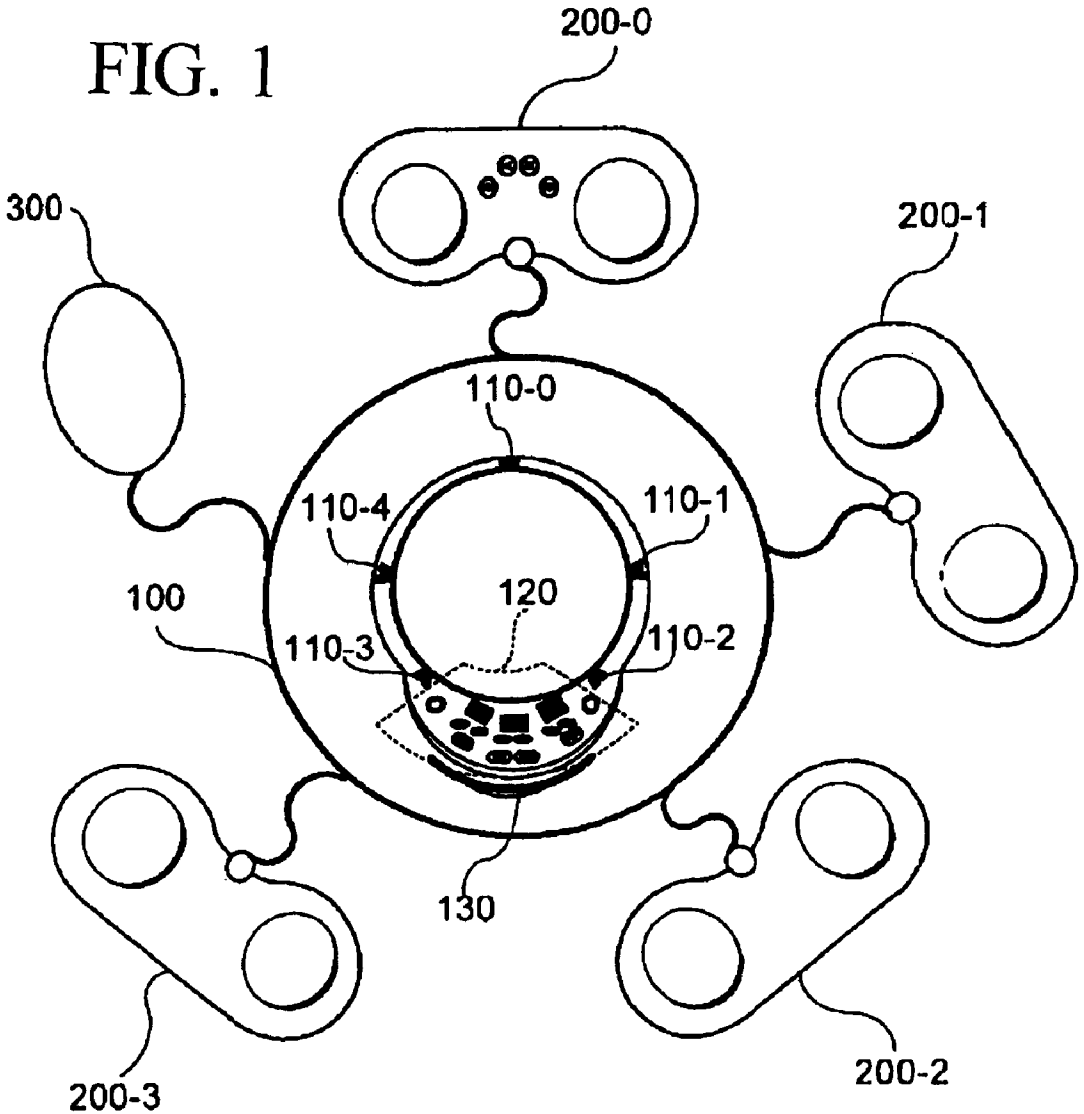
FIG. 1 is a plan view showing an overall appearance of an electronic musical instrument constructed by a main unit and five operators in accordance with a preferred embodiment of the invention.

FIG. 1 shows an overall appearance of the electronic musical instrument of the present embodiment in plan view. Basically, the electronic musical instrument is constructed by a main unit 100 for generation of musical tones and four pad operators (or performance operators using pads) 200-0 to 200-4 (hereinafter, simply referred to as pad operators 200) and a single hold operator 300. Each of the pad operators 200 is manually operated by a user to produce instructions for generation of designated musical tones.

Figure 2:
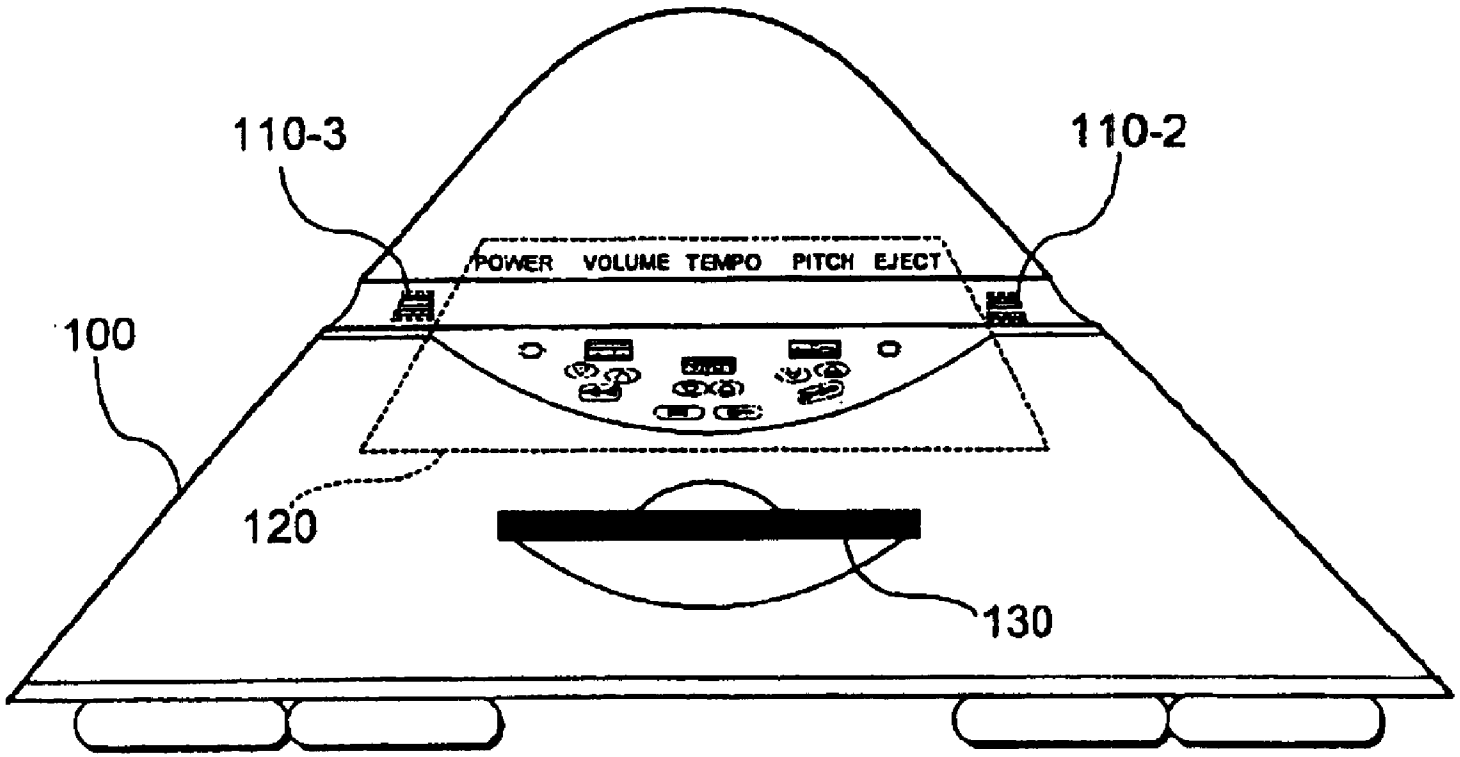
FIG. 2 is a side view showing an appearance of the main unit providing a control panel and a floppy disk drive.

FIG. 2 shows an appearance of the main unit 100 in side view. As shown in FIGS. 1 and 2, the main unit 100 installs five speakers 110-0 to 110-4 (hereinafter, simply referred to as speakers 100) which are arranged around a center portion thereof and each of which produces musical tones which are designated by the pad operator 200. In addition, the main unit 100 installs a control panel 120, which is arranged between the speakers 110-2 and 110-3, and a floppy disk drive (FDD) 130 which is arranged under the control panel 120.

Figure 3:
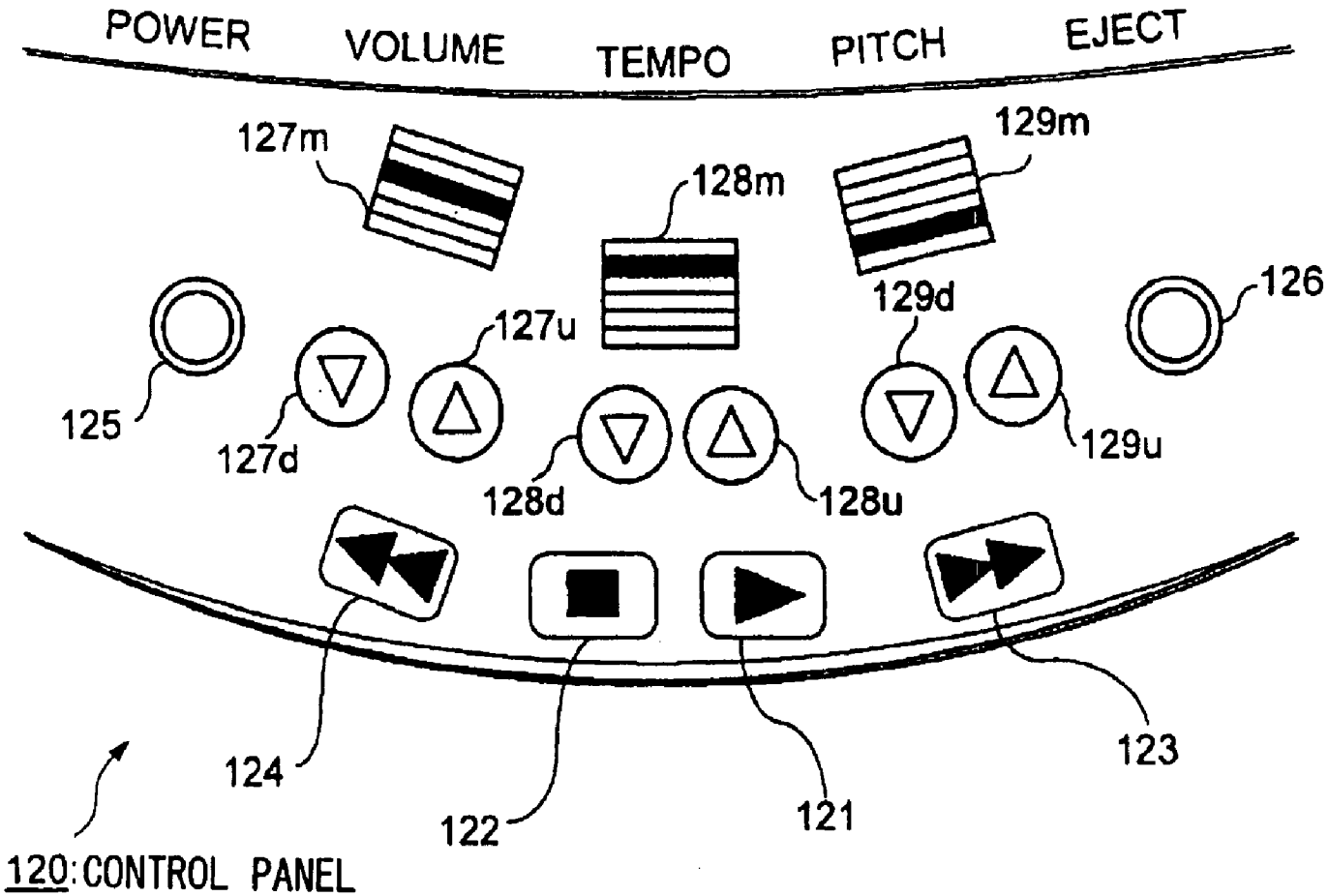
FIG. 3 is an enlarged view showing arrangement of switches and indicators on the control panel.

The control panel 120 is a user interface that is used by a user to make various kinds of setting and controls. As shown in FIG. 3 whose details will be described later, the control panel 120 provides various kinds of switches and indicators (i.e., light emitting diodes) for showing prescribed conditions of setting being made. The floppy disk drive 130 reads or writes data on a floppy disk being inserted therein. The present embodiment merely describes the floppy disk drive 130 to have a function of reading in prescribed information and data that are written on the floppy disk in advance.

FIG. 3 is an enlarged view showing arrangement of switches and indicators on the control panel 120. The control panel 120 is mainly used for controls of automatic performance. Namely, the control panel 120 installs a play switch 121, a stop switch 122, a fast forward switch 123, a rewind (or reverse) switch 124, a power switch 125 and an eject switch 126. In addition, the control panel 120 also installs tone volume switches 127*d*, 127*u* and a tone volume indicator 127*m*, tempo switches 128*d*, 128*u* and a tempo indicator 128*m*, modulation switches 129*d*, 129*u* and a modulation indicator 129*m*.

The aforementioned switches are manually pressed by the user to instruct prescribed operations. Namely, the play switch 121 instructs a start of playback of automatic performance, which will be described later. The stop switch 122 instructs a stop of playback of the automatic performance. The fast forward switch 123 initiates fast forward play of the automatic performance by a prescribed multiple speed. The rewind switch 124 initiates rewind (or reverse) play of the automatic performance by a prescribed multiple speed.

The power switch 125 designates electric power to be applied or cut out on the electronic musical instrument. The eject switch 126 designates eject of a floppy disk inserted into the floppy disk drive 130.

The tone volume switches 127*d*, 127*u* are used to designate a tone volume (VOLUME) of the automatic performance being played. Herein, the tone volume switch 127*d* designates decrease of the tone volume, while the tone volume switch 127*u* designates increase of the tone volume. The tone volume indicator 127*m* installs a prescribed number of LEDs for indication of the tone volume presently designated. Herein, the tone volume indicator 127*m* is configured by a prescribed number of blocks corresponding to the LEDs, one of which is selectively lighted. Every time the tone volume switch 127*d* is pressed, light (see highlighted "black" block) of the tone volume indicator 127*m* moves downwardly in view of the user who is seated at a main unit 100 to watch the control panel 120 as shown in FIG. 3. Every time the tone volume switch 127*u* is pressed, light of the tone volume indicator 127*m* moves upwardly in view of the user.

The tempo switches 128*d*, 128*u* are used to designate a tempo (TEMPO) of the automatic performance being played. Herein, the tempo switch 128*d* slows down the tempo, while the tempo switch 128*u* increases the tempo. The tempo indicator 128*m* is configured by a prescribed number of LEDs for indication of the tempo presently designated. That is, the tempo indicator 128*m* is configured by a prescribed number of blocks corresponding to the LEDs, one of which is selectively lighted. Every time the tempo switch 128*d* is pressed, light (see highlighted "black" block) of the tempo indicator 128*m* moves downwardly in view of the user. Every time the tempo switch 128*u* is pressed, light of the tempo indicator 128*m* moves upwardly in view of the user.

The modulation switches 129*d*, 129*u* are used to designate modulation (namely, a change of a tone pitch (PITCH)) of the automatic performance being played. Herein, the modulation switch 129*d* designates decrease of a key in pitch, while the modulation switch 129*u* designates increase of a key in pitch. The modulation indicator 129*m* is configured by a prescribed number of LEDs for indication of modulation presently designated. That is, the modulation indicator 129*m* is configured by a prescribed number of blocks corresponding to the LEDs, one of which is selectively lighted. Every time the modulation switch 129*d* is pressed, light (see highlighted "black" block) of the modulation indicator 129*m* moves downwardly in view of the user. Every time the modulation switch 129*u* is pressed, light of the modulation indicator 129*m* moves upwardly in view of the user.

The tone volume switches 127*d*, 127*u* designate a relative value in modification from an average value of the tone volume. In addition, the tempo switches 128*d*, 128*u* designate a relative value in modification from an average value of the tempo. Further, the modulation switches 129*d*, 129*u* designate a relative value in modification from an average value of the key. Concretely speaking, the present embodiment is designed such that six steps are provided for the modification of the tone volume, tempo and key respectively. Hence, one of the six steps is designated by turning on the corresponding LED in each of the indicators 127*m*, 128*m* and 129*m*. The aforementioned floppy disk stores performance information that contain the average values of the tone volume, tempo and key.

Next, hardware of the pad operators 200 will be described with reference to FIGS. 4 and 5.

The pad operator 200 installs two pads 201, each of which has a circular striking surface to be struck with a stick or else. Striking forces respectively applied to the pads 201 are detected by sensors (not shown) and are converted to electric signals.

Figure 4:
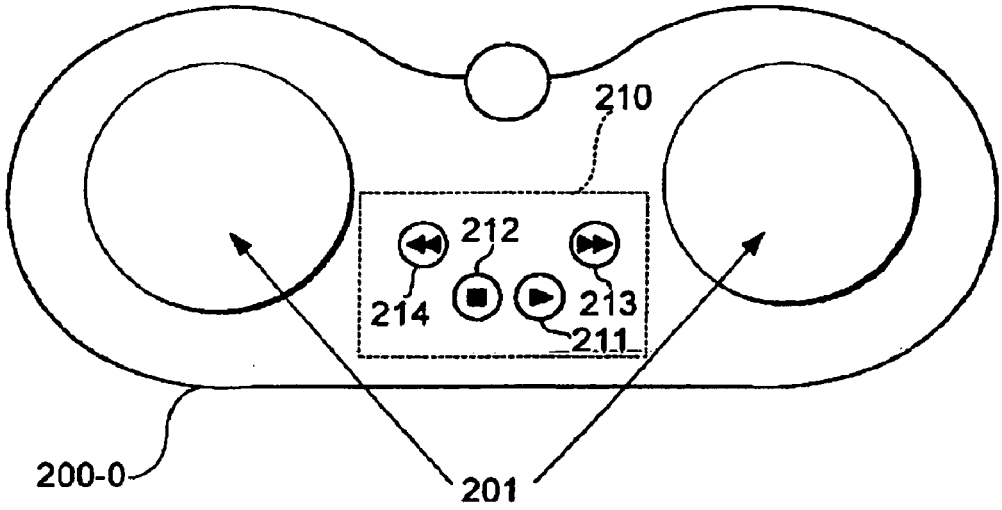
FIG. 4 is a plan view showing an appearance of an pad operator that installs a sub panel in addition to pads.
Figure 5:
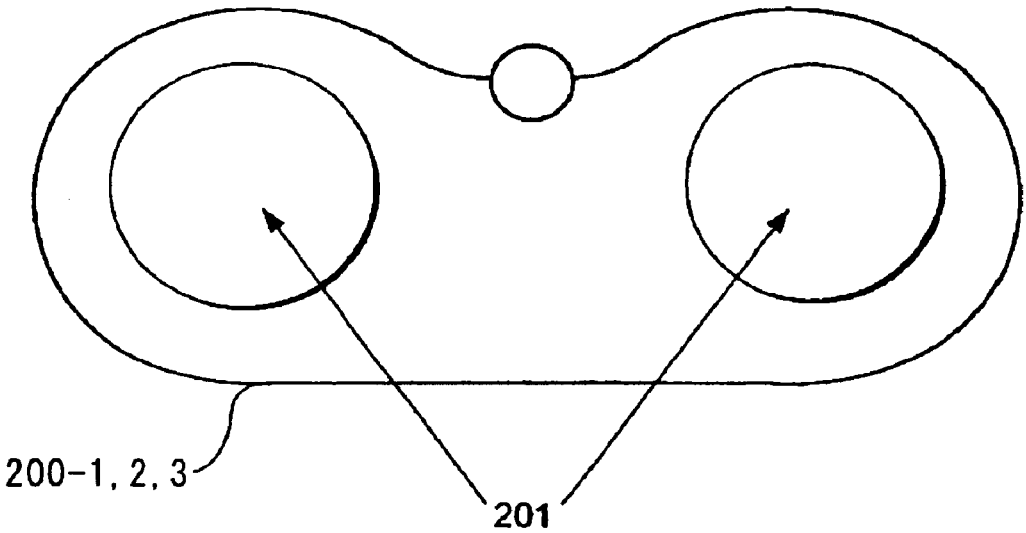
FIG. 5 is a plan view showing an appearance of pad operators each of which merely installs pads.

The present embodiment installs two types of the pad operators, namely, the operator 200-0 specifically installing a sub panel 210 as shown in FIG. 4 and other operators 200-1 to 200-3 each merely installing two pads 201 as shown in FIG. 5. The sub panel 210 installs a play switch 211, a stop switch 212, a fast forward switch 213 and a rewind (or reverse) switch 214. Those switches 211, 212, 213 and 214 of the sub panel 210 respectively have same functions of the aforementioned switches 121, 122, 123 and 124 of the control panel 120.

Figure 6:
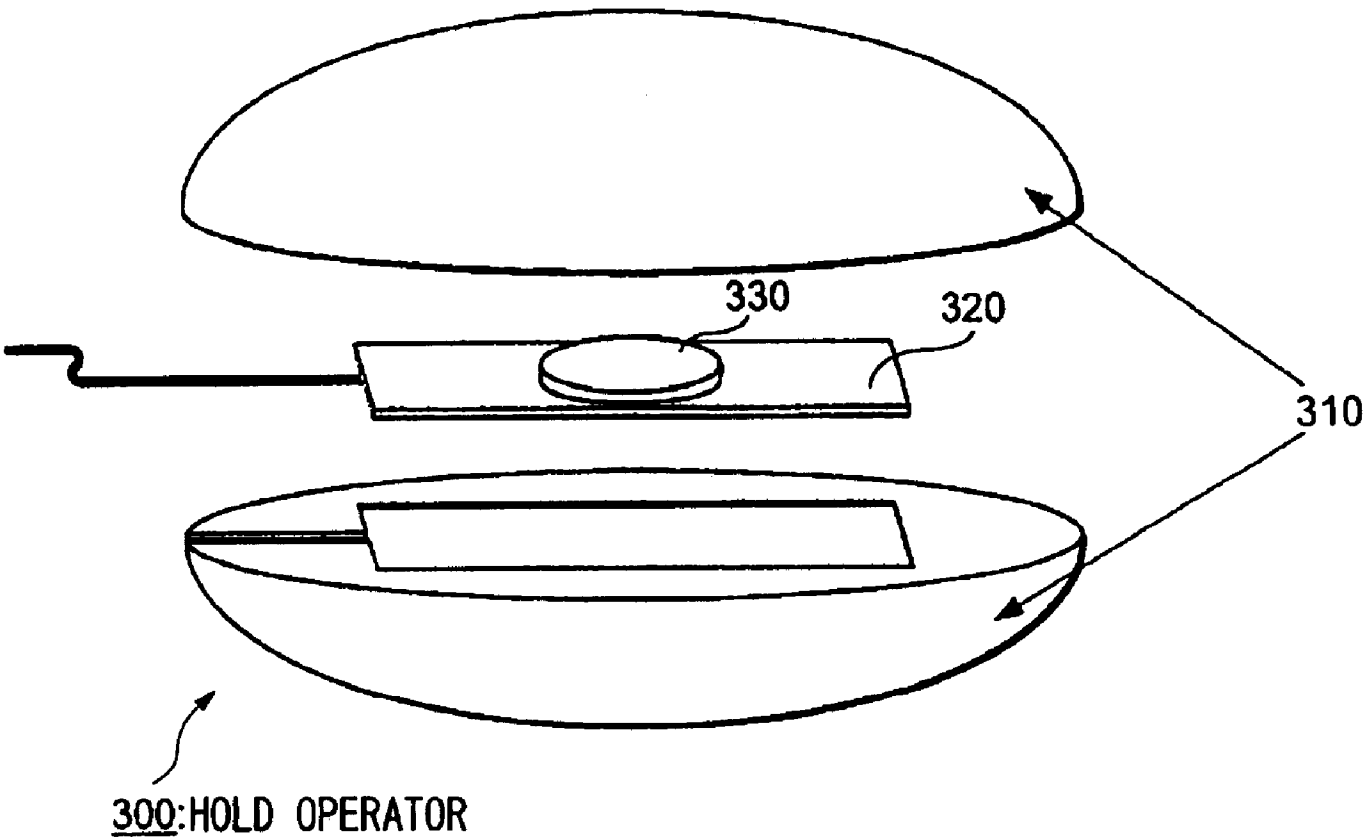
FIG. 6 is an exploded view showing a mechanical construction of a hold operator which is connected with the main unit of the electronic musical instrument shown in FIG. 1.

Next, a mechanical construction of the hold operator 300 will be described with reference to FIG. 6.

The hold operator 300 is constructed by forming a prescribed material member having elasticity roughly in a spherical shape or an egg-like shape which is suited for grip of the user. Thus, the hold operator 300 is held or grasped by a hand of the user to control musical performance in prescribed musical parameters.

Concretely speaking, the hold operator 300 is constructed using a hold member 310 which has a prescribed shape suited for grip of the user and which encapsulates a base member 320 and a sensor 330 for detection of a hold operation of the user. That is, the hold member 310 is formed to encapsulate the sensor 330 mounted on the base member 320 therein.

As the material for formation of the hold member 310, it is possible to use elastic materials such as urethane foam, which is selected such that the sensor 330 is capable of detecting pressure applied to the hold member 310.

As the base member 320, it is possible to use hard materials such as glass fiber material which is not easily deformed. As the sensor 330 mounted on the base member 320, it is possible to use any types of sensors having pressure sensitivity such as the piezoelectric sensor. Thus, pressure applied to the hold member 310 is detected by the sensor 330 and is converted to electric signals, which are successively transmitted to the main unit 100.

With reference to FIG. 1, a description will be given with respect to arrangement of hardware elements of the electronic musical instrument.

The main unit 100 and each of the pad operators 200 are connected together by way of a cable having a prescribed length. The pad operators 200 are accommodated for multiple users to play or control musical performance in an ensemble, wherein each of the pad operators 200 is operated by each user. Herein, each user is capable of holding and freely moving the pad operator 200 within an allowable range of distance being defined by the length of the cable.

Roughly speaking, the main unit 100 as a whole is formed in a conical shape, which is suited for transportation. The pad operators 200 are subjected to radial arrangement about a center of the conical shape and are roundly arranged to depart from each other by intervals of a prescribed angle, i.e., 75 degree. The pad operators 200-0 to 200-3 are provided in connection with the speakers 110-0 to 110-3 respectively. Herein, each of the speakers 110 is arranged along a conduction line to produce musical tones in a direction toward the corresponding pad operator 200. Thus, the users are able to clearly listen to the musical tones which are produced in all directions from the main unit 100.

As described above, the electronic musical instrument of the present embodiment is configured such that at least one performance operator is configured as the hold operator 300, which allows the user(s) to control musical performance with simple operations so that inexperienced users such as children and aged persons who have difficulties in learning performance of musical instruments are able to easily participate in musical performance. It is an outstanding feature that the present electronic musical instrument provides a new manner of musical performance corresponding to "hold" in an ensemble play of music.

(2) Electronic Configuration

Figure 7:
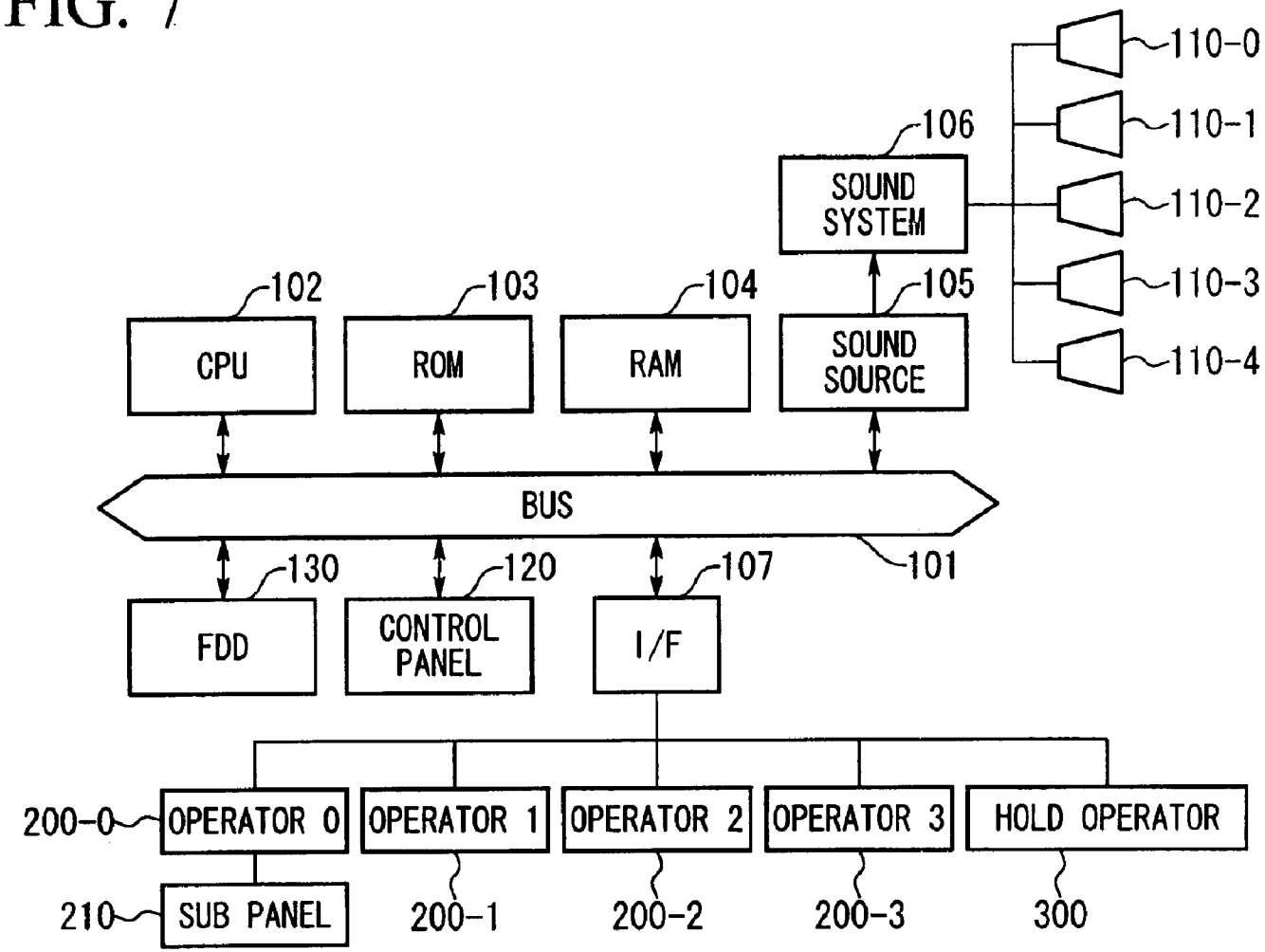
FIG. 7 is a block diagram showing an electronic configuration of the electronic musical instrument.

With reference to FIG. 7, an electronic configuration of the electronic musical instrument will be described in accordance with the preferred embodiment of the invention. In FIG. 7, a bus 101 interconnects together various elements and components, namely, a CPU 102, a ROM 103, a RAM 104, a sound source 105 and an operator interface (I/F) 107 as well as the control panel 120 and floppy disk drive (FDD) 130. In addition, a sound system (SS) 106 coupled with the sound source 105 is connected with the aforementioned speakers 110-0 to 110-4 of the main unit 100 shown in FIG. 1. Further, the operator interface 107 is connected with the aforementioned pad operators 200-0 to 200-3 and hold operator 300 shown in FIG. 1. Furthermore, the operator 200-0 is equipped with the sub panel 210.

Figure 9:
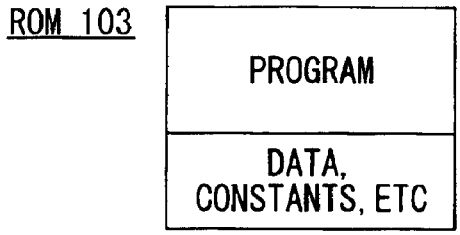
FIG. 9 shows stored content of a ROM shown in FIG. 7.

The CPU 102 performs controls on several parts of the electronic musical instrument, which are interconnected together by way of the bus 101, on the basis of programs stored in the ROM 103. As shown in FIG. 9, the ROM 103 stores control programs, parameters, constants, initialization data, etc.

Figure 10:
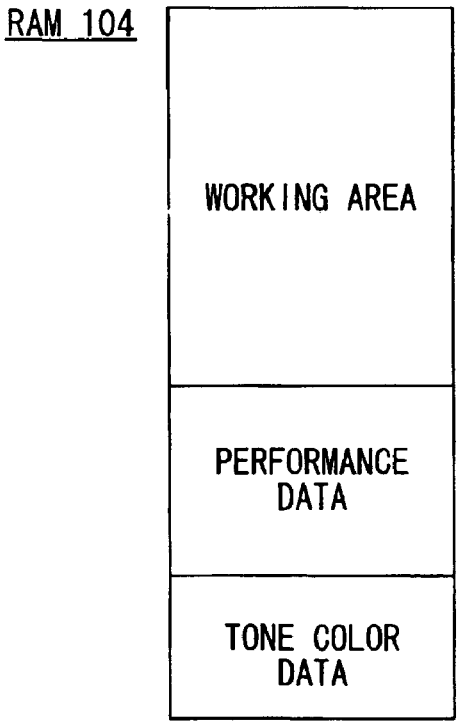
FIG. 10 shows stored content of a RAM shown in FIG. 7.

As shown in FIG. 10, the RAM 104 contains rewritable storage areas such as a working area and other areas for storing performance data and tone color data, for example. Herein, the performance data represent contents of automatic performance, and the tone color data represent tone colors used for generation of musical tones.

Figure 8:
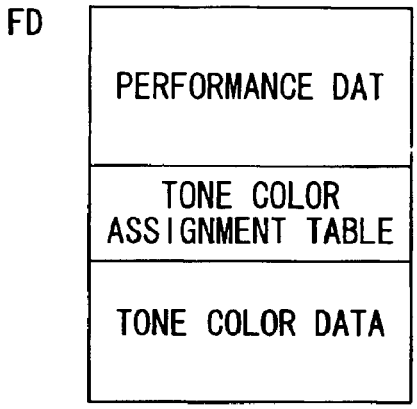
FIG. 8 shows stored content of a floppy disk.

Data stored in the RAM 104 correspond to data read from the floppy disk inserted into the floppy disk drive 130. As shown in FIG. 8, the present embodiment describes such that each one floppy disk records performance data and tone color data with respect to a prescribed single musical tune. In addition, the floppy disk also records a tone color assignment table showing preset assignment of tone colors to the pad operators 200 with respect to the prescribed musical tune. In accordance with content of the tone color assignment table, assignment information of tone colors is transferred to the working area of the RAM 104.

The present embodiment describes such that the performance data correspond to MIDI data, which describe data representing tone pitches and velocities as well as time information in accordance with a prescribed MIDI format (where "MIDI" represents the standard for "Musical Instrument Digital Interface").

Under control of the CPU 102, the sound source 105 generates musical tone signals based on the MIDI data stored in the RAM 104. That is, the sound source 105 is designed based on the waveform data reproduction system to read and reproduce waveform data corresponding to the tone color data stored in the RAM 104. The musical tone signals generated by the sound source 105 are amplified by the sound system 106, so that corresponding musical tones are produced by the speakers 110-0 to 110-4.

In the present embodiment, the performance data contain MIDI data corresponding to at least a prescribed part within plural parts of the musical tune. Thus, automatic performance is executed based on the MIDI data corresponding to the prescribed part of the musical tune. In addition, the present embodiment allows the pad operators 200 and hold operator 300 to instruct generation of musical tones using tone colors being assigned to other parts other than the prescribed part in the musical tune.

[B] Operation and Process

Next, operations and processes of the present embodiment will be described in connection with the electronic musical instrument shown in FIGS. 1 and 7.

(1) Outline Operation

First, an outline operation will be described with respect to the electronic musical instrument of the present embodiment, which is designed to allow generation of musical tones based on performance data of automatic performance and manual operations that are made by users operating the pad operators 200 and hold operator 300 in playing musical performance. Herein, each user strikes the pads 201 of the pad operator 200 with a stick, fingers or hands, while each user holds the hold operator 300 with his/her hand. In addition, a prescribed tone color is assigned to each operator. When the user operates the pad operator 200 or hold operator 300, the main unit 100 generates musical tones using the prescribed tone color assigned to the pad operator 200 or hold operator 300. When a floppy disk is inserted into the floppy disk drive 130, its information and data are transferred to the RAM 104 of the main unit 100, which in turn proceeds to assignment of tone colors to the operators.

FIGS. 11 to 13 and FIGS. 16, 17 show processes being executed by the CPU 102 to run programs for generation of musical tones based on the performance data and manual operations of the operators, details of which will be described below.

(2) Detailed Operations (a) Main Routine

Figure 11:
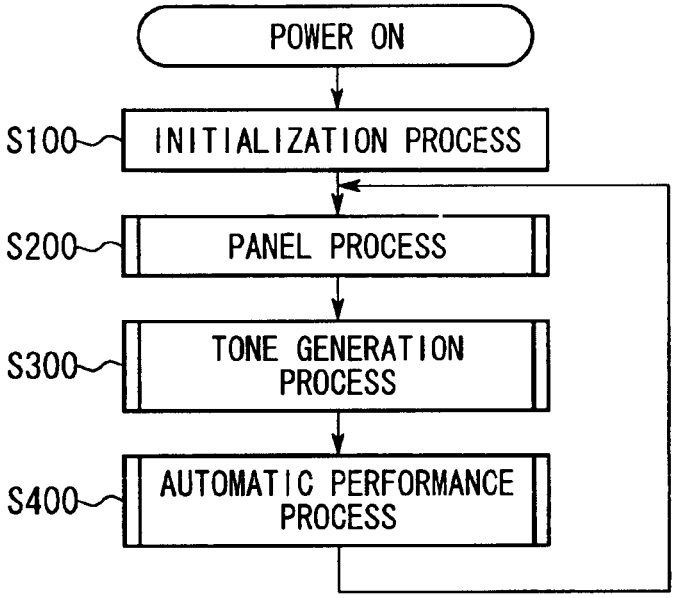
FIG. 11 is a flowchart showing a main routine of a musical tone control program.

FIG. 11 shows a main routine of a musical tone control program. When the user presses the power switch 125 on the control panel 120 shown in FIG. 3, electric power is applied to the main unit 100 in which the CPU 102 starts processing in accordance with programs stored in the ROM 103. In execution of the main routine of FIG. 11, a flow firstly proceeds to step S100 in which the CPU 102 proceeds to initialization process (or initial setting process) on the RAM 104.

After completion of the initialization process, the flow proceeds to step S200 in which a panel process is executed based on manual operations of the control panel 120 or sub panel 210. Then, the flow proceeds to step S300 in which a tone generation process is executed upon detection of manual operations (namely, striking operations of the pads 201 of the pad operators 200 and a hold operation of the hold operator 300) to designate generation of musical tones. Then, the flow proceeds to step S400 in which an automatic performance process is executed based on performance data. After the CPU 102 sequentially executes the aforementioned processes of steps S200, S300 and S400, the flow proceeds back to step S200 again. That is, the CPU 102 repeats a series of prescribed subroutines corresponding to steps S200 to S400 in a circulating manner until the electric power to the main unit 100 is cut off.

Next, descriptions will be made with respect to the subroutines of steps S200, S300 and S400 respectively.

(b) Panel Process

Figure 12:
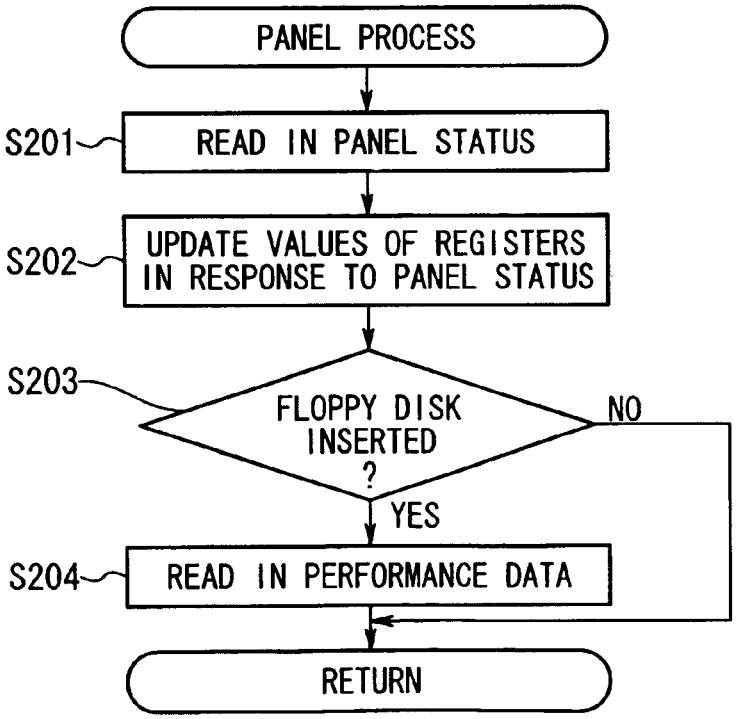
FIG. 12 is a flowchart showing a panel process of the musical tone control program.

FIG. 12 shows details of the panel process of step S200. When the panel process is started, a flow firstly proceeds to step S201 in which the CPU 102 reads in a panel status of the control panel 120 or sub panel 210. In step S202, the CPU 102 updates values of registers (not shown) in response to the panel status. Herein, the panel status represents on/off states of switches of the control panel 120 or sub panel 210. Upon detection of manual operations applied to the switches, their switching information representing switch-on/off events is accumulated in a prescribed buffer (not shown). Hence, the CPU 102 reads in the switching information from the buffer as the panel status.

The present embodiment sets in the working area of the RAM 104 three types of registers for storing values of the tone volume, tempo and modulation respectively. Those values of the registers are sequentially updated in response to manual operations applied to the corresponding switches. For example, when the user presses the tone volume switch 127*d* one time, the CPU 102 detects a switch-on event of the switch 127*d* to decrement the value of the tone volume register by '1'. When the user presses the tone volume switch 127*u* one time, the CPU 102 detects a switch-on event of the switch 127*u* to increment the value of the tone volume register by '1'.

After the CPU 102 updates values of the registers in step S202, the flow proceeds to step S203 in which a decision is made as to whether a floppy disk is newly inserted into the floppy disk drive 130 or not. The present embodiment is designed such that the CPU 102 reads in performance data from the floppy disk in step S204 only when the floppy disk is newly inserted into the floppy disk drive 130, namely, only when a decision result of step S203 is "YES". If the floppy disk is newly inserted into the floppy disk drive 130 during progress of automatic performance, the CPU 102 compulsorily terminates execution of the automatic performance to clear assignment of tone colors to the operators 200, then, the CPU 102 reads in the performance data from the floppy disk newly inserted. After completely reading in the performance data, the CPU 102 reverts control to the main routine.

If the CPU 102 determines in step S203 that no floppy disk is inserted into the floppy disk drive 130, namely, if a decision result of step S203 is "NO", the CPU 102 directly reverts control to the main routine without proceeding to step S204.

(c) Tone Generation Process

Figure 13:
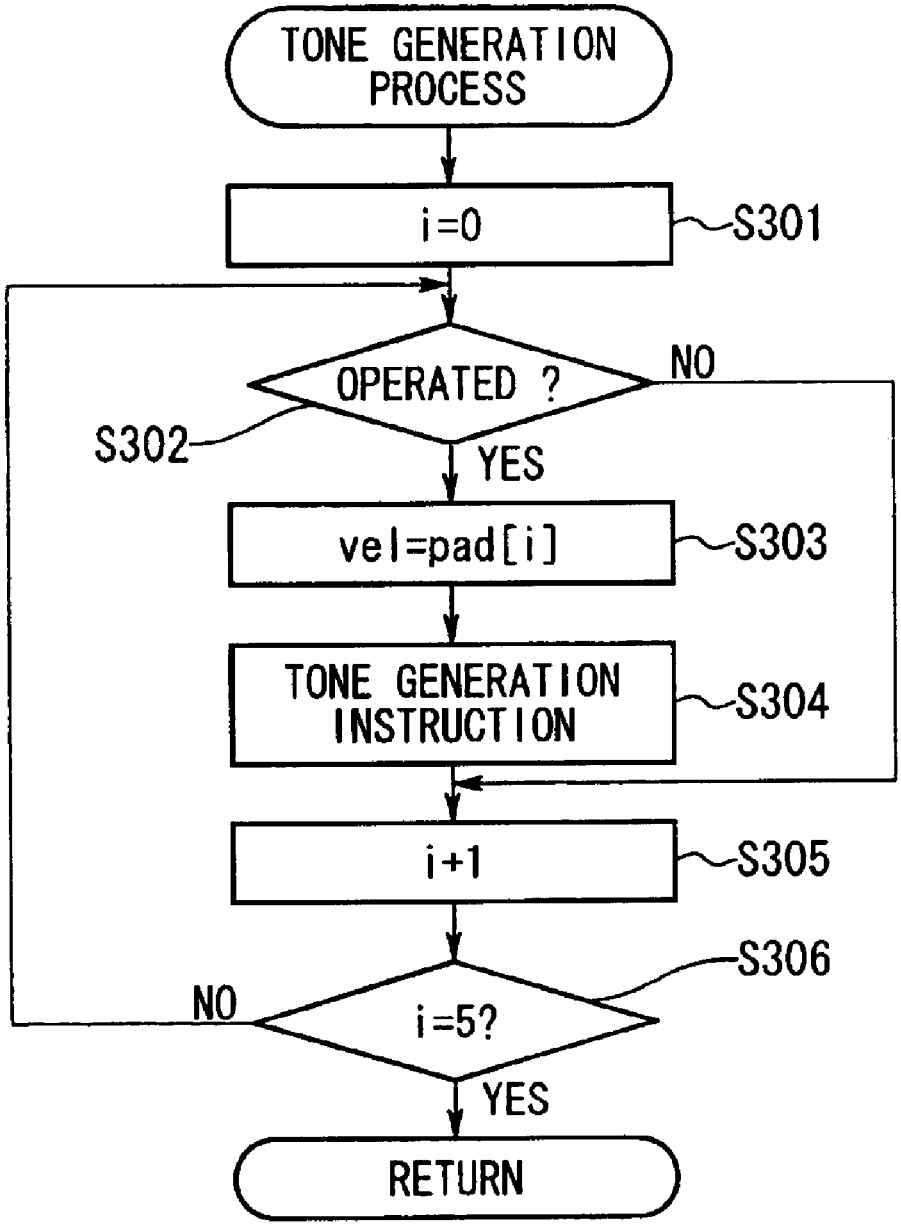
FIG. 13 is a flowchart showing a tone generation process of the musical tone control program.

FIG. 13 shows details of the tone generation process of step S300. Herein, a variable i is used for identification of the pads 201 of the pad operators 200 and the sensor 330 of the hold operator 300. Namely, the variable i is set to '0' in connection with pads 201-0 mounted on the pad operator 200-0. Similarly, the variable i is set to '1' in connection with pads 201-1, '2' in connection with pads 201-2, and '3' in connection with pads 201-3 respectively. Further, the variable i is set to '4' in connection with the sensor 330.

When the CPU 102 starts the tone generation process of FIG. 13, a flow firstly proceeds to step S301 in which the variable i is initially set to '0'. In step S302, a decision is made as to whether the user strikes the pad(s) 201-0 of the pad operator 200-0 or not.

If the CPU 102 determines in step S302 that the user strikes the pad(s) 201-0 of the pad operator 200-0, namely, if a decision result of step S302 is "YES", the flow proceeds to step S303 in which striking intensity is detected and is used as velocity being designated by the operator 200-0. In step S304, the CPU 102 issues a tone-generation instruction to the sound source 105 in response to the velocity designated by the operator 200-0. Upon receipt of the tone-generation instruction, the sound source 105 generates musical tone signals having a tone color which is assigned to the operator 200-0 in advance. The musical tone signals are forwarded to the sound system 106. Incidentally, information regarding determination as to whether a striking operation is applied to the pad 201 and its striking intensity is accumulated in a buffer (not shown) every time the CPU 102 detects the striking operation applied to the pad 201.

Next, a description will be given with respect to the case of i=4 in which the CPU 102 proceeds to a tone generation process in steps S302 to S304 with regard to the hold operator 300.

When the sensor 330 detects a hold operation in which the user holds the hold operator 300 with his/her hand, it detects intensity of pressure applied to the hold member 310. As similar to the foregoing striking operations of the pads 201 being successively accumulated in the buffer, the detected intensity of pressure is accumulated in a prescribed buffer every time it is detected.

In step S302, the CPU 102 makes a decision as to whether the hold operator 300 is held by the user or not on the basis of variations of the pressure, namely, differential values of the pressure. Concretely speaking, if the differential value is above a prescribed threshold, the CPU 102 determines in step S302 that the hold operator 300 is presently held by the user.

If the CPU 102 determines that the hold operator 300 is presently held by the user, namely, if a decision result of step S302 is "YES", the CPU 102 uses the detected intensity of pressure as a velocity being designated by the hold operator 300 in step S303. In step S304, the CPU 102 issues a tone-generation instruction to the sound source 105 in response to the designated velocity.

Figure 14:
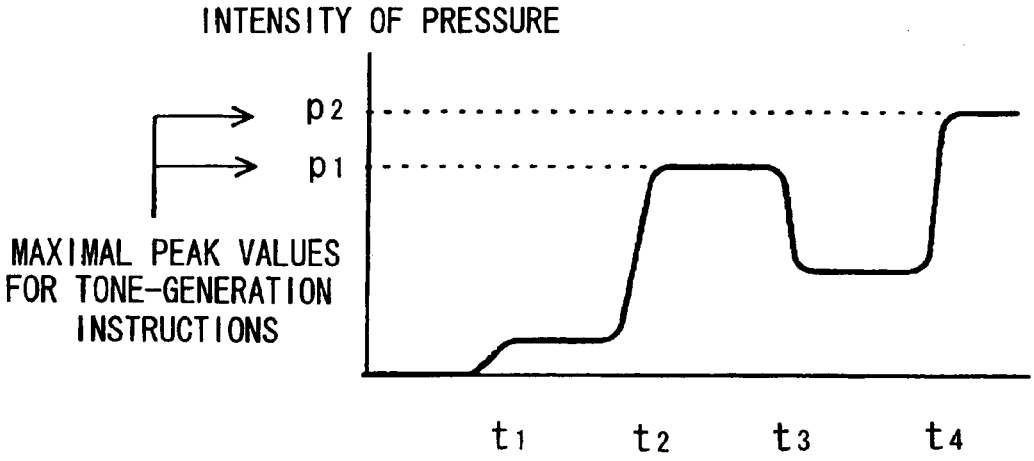
FIG. 14 is a graph showing variations of pressure intensities being applied to and detected by the hold operator with respect to time.
Figure 15:
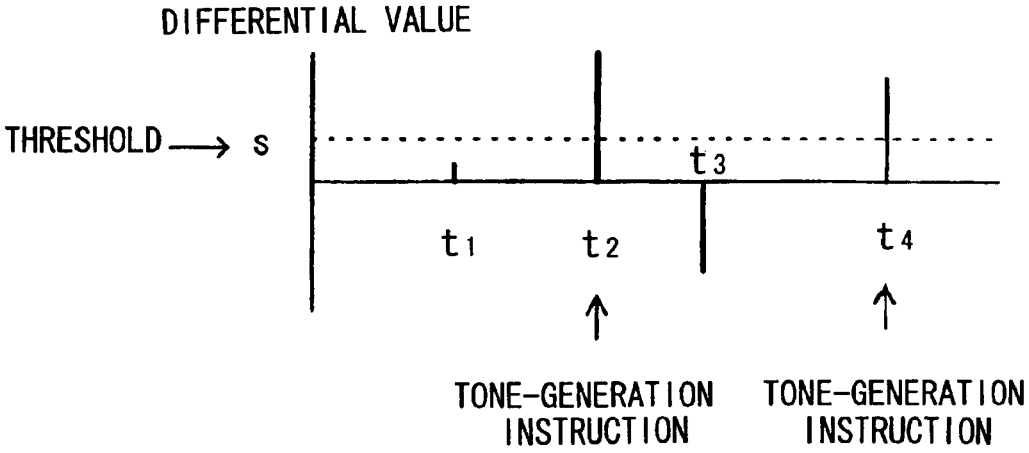
FIG. 15 is a graph showing variations of differential values that are calculated by differentiating the detected pressure intensities with respect to time.

The aforementioned detection and determination will be described in more detail with reference to FIGS. 14 and 15. FIG. 14 shows variations of detected pressure intensities output from the sensor 330 with respect to time. FIG. 15 shows variations of differential values, being calculated by differentiating the detected pressure intensities, with respect to time. FIG. 15 shows that four peaks appear in the variations of the differential values of the detected pressure intensities at times t1, t2, t3 and t4 respectively. Herein, two peaks appeared at the times t2 and t4 exceed a threshold "s" which is set in advance with respect to the differential values of the detected pressure intensities shown in FIG. 15.

It is described before that the present embodiment is designed to issue a tone-generation instruction when the differential value of the detected pressure intensity exceeds the threshold s. Hence, the CPU 102 determines that the hold operator 300 is held by the user in the decision of step S302 which is executed at the times t2 and t4 respectively. At time t2, detected pressure intensity is p1, which is used as a velocity in step S303 so that the CPU 102 issues a tone-generation instruction to the sound source 105 in step S304. At time t4, detected pressure intensity is p2, which is used as a velocity in step S303 so that the CPU 102 issues a tone-generation instruction to the sound source 105 in step S304.

As described above, the velocity connected with issuance of the tone-generation instruction corresponds to a maximal peak value (e.g., p1, p2 shown in FIG. 14) in the pressure intensity being detected every prescribed cycle.

Incidentally, it is possible to provide the electronic musical instrument with a switch or control (not shown) which is operated by the user to arbitrarily set the threshold s. Or, it is possible to provide a preset value read from the floppy disk as the threshold s. Or, the hold operator 300 is modified to have a function for adjustment of sensitivity (i.e., threshold) in detection of pressure in response to user's physical ability of holding substance such as grip force of the user, for example.

With reference to FIG. 13 again, after issuance of the tone-generation instruction in step S304 or if a decision result of step S302 is "NO" declaring that no manual operation is applied to the operator(s), the flow proceeds to step S305 in which the variable i is incremented by '1' to newly designate the operator which is to be subjected to tone generation process in a next cycle.

In step S306, a decision is made as to whether the tone generation process is completely executed on all of the operators or not. As described before, the present embodiment provides five operators (namely, four pad operators 200-0 to 200-3 and one hold operator 300) being connected with the main unit 100, so that the variable i is changed within a prescribed range of values between '0' and '4' in connection with the pads 201 and sensor 330. So, when the variable i is incremented in step S305 to reach '5', the CPU 102 determines in step S306 that the tone generation process is completed on all of the operators.

If i=5 in step S306, namely, if a decision result of step S306 is "YES", the CPU 102 ends the tone generation process to revert control to the main routine. If the variable i is not equal to '5', namely, if a decision result of step S306 is "NO", the flow returns to step S302 in which a decision is made as to whether a manual operation is applied to the next operator being designated by the incremented value of the variable i in step S305 or not.

(d) Automatic Performance Process

Figure 16:
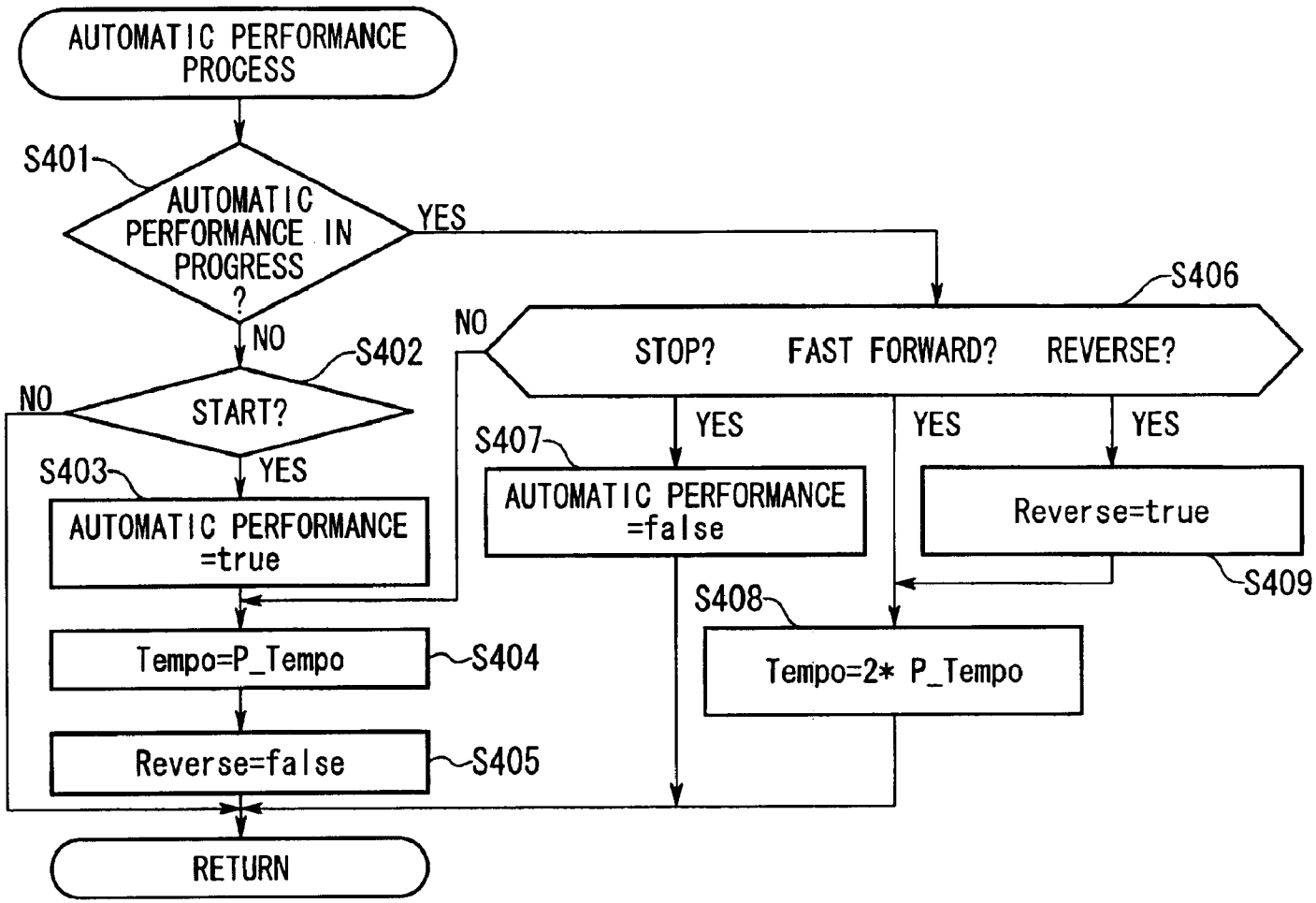
FIG. 16 is a flowchart showing an automatic performance process of the musical tone control program.
Figure 17:
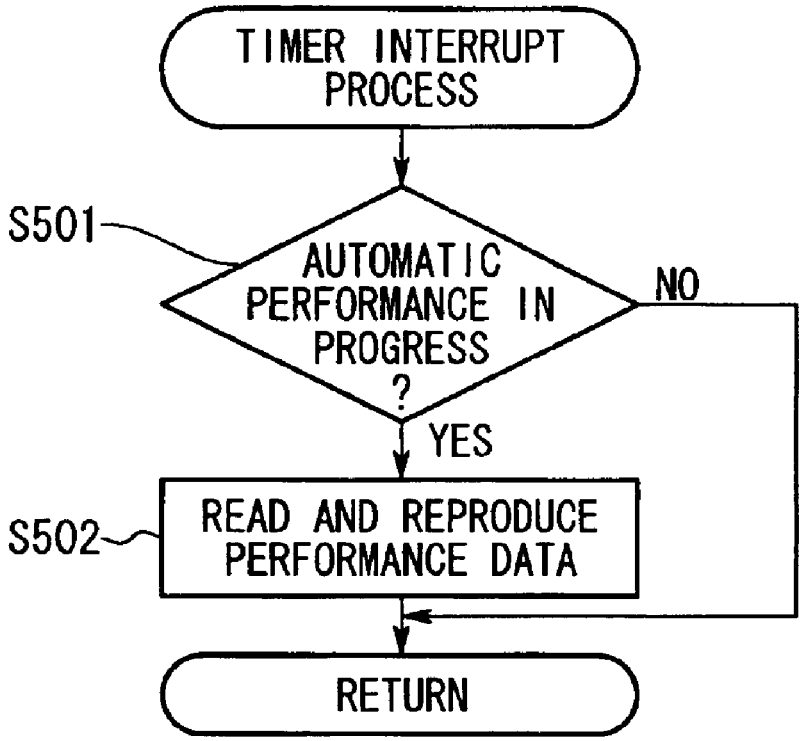
FIG. 17 is a flowchart showing a timer interrupt process.

FIG. 16 is a flowchart showing details of the automatic performance process of step S400. The automatic performance process is a routine for setting of automatic performance, wherein the CPU 102 proceeds to automatic performance by periodically executing a timer interrupt process to read out performance data every prescribed period, so that the sound source 105 generates musical tone signals representing musical tones to be produced in the automatic performance.

In the present embodiment, a register indicating a status of automatic performance (hereinafter, referred to as an automatic performance status register) is set in the working area of the RAM 104. As for content of the register, the flowchart of FIG. 16 describes "true" for representation of an activated condition where processing of automatic performance is under progress, or it describes "false" for representation of an inactivated condition where processing of automatic performance is not carried out.

In addition, a register indicating a status of reverse play of performance (in which notes of a musical tune are reversely played back to produce reverse sounds in music) is set in the working area of the RAM 104. This register will be referred to as a reverse play status register. As for content of the reverse play status register, the flowchart of FIG. 16 describes "true" for representation of an activated condition where processing of reverse performance is under progress, or it describes "false" for representation of an inactivated condition where processing of reverse performance is not carried out.

Further, a variable "Tempo" represents a readout speed of performance data. In FIG. 16, a reference symbol "P_Tempo" designates a value which is updated by the aforementioned panel process. That is, it designates a certain value included in the performance data or a value of tempo which is updated by manual operations of the tempo switches 128*d*, 128*u*.

When the automatic performance process of FIG. 16 is started, a flow firstly proceeds to step S401 in which based on content of the automatic performance status register, a decision is made as to whether the electronic musical instrument is presently playing automatic performance or not.

If the CPU 102 determines that the automatic performance is not played, namely, if a decision result of step S401 is "NO", the flow proceeds to step S402 in which a decision is made as to whether the user instructs the electronic musical instrument to start the automatic performance or not. That is, a decision is made as to whether the user presses either the play switch 121 of the control panel 120 (see FIG. 3) or the play switch 211 of the sub panel 210 (see FIG. 4) or not. If the CPU 102 determines in step S402 that the user does not instruct the electronic musical instrument to start the automatic performance, namely, if a decision result of step S402 is "NO", the CPU 102 ends the automatic performance process to revert control to the main routine.

If the CPU 102 determines in step S402 that the user instructs the electronic musical instrument to start the automatic performance, namely, if a decision result of step S402 is "YES", the flow proceeds to step S403 in which the CPU 102 describes "true" in the automatic performance status register. At this time, the automatic performance is started in a normal manner, in other words, the automatic performance is not subjected to fast forward play or reverse play. In step S404, the variable Tempo is set to P_Tempo, that is, a tempo of the automatic performance is set to a value which is updated by the panel process. In step S405, the CPU 102 describes "false" in the reverse play status register. Then, the CPU 102 reverts control to the main routine.

If the CPU 102 determines in step S401 that the electronic musical instrument is presently playing the automatic performance, namely, if a decision result of step S401 is "YES", the flow proceeds to step S406 in which a decision is made as to whether any change of status is designated for the automatic performance, which is presently under progress in the normal manner, or not. As changes of the status, it is possible to list three controls, namely, stop, fast forward and reverse (or rewind). So, the CPU 102 discriminates a presently designated change of status among them. If the user presses the stop switch 122 of the control panel 120 or the stop switch 212 of the sub panel 210, the CPU 102 determines in step S406 that the user instructs to stop the automatic performance. It is described before that on/off information of the stop switch is accumulated in the prescribed buffer. If the user presses the fast forward switch 123 of the control panel 120 or the fast forward switch 213 of the sub panel 210, the CPU 102 determines in step S406 that the user designates fast forward play of the automatic performance. If the user presses the rewind switch 124 of the control panel 120 or the rewind switch 214 of the sub panel 210, the CPU 102 determines in step S406 that the user designates reverse play of the automatic performance.

If the CPU 102 determines in step S406 that the user instructs to stop the automatic performance, namely, if a decision result of "STOP" is "YES", the flow proceeds to step S407 in which the CPU 102 changes content of the automatic performance status register to describe "false". In addition, the CPU 102 returns a readout position of the performance data to a top position. Then, the CPU 102 reverts control to the main routine.

If the CPU 102 determines in step S406 that the user designates the fast forward play of the automatic performance, namely, if a decision result of "FAST FORWARD" is "YES", the flow proceeds to step S408 in which the CPU 102 doubles the value of the variable P_Tempo to double the readout speed of the performance data. Then, the CPU 102 reverts control to the main routine.

If the CPU 102 determines in step S406 that the user designates the reverse play of the automatic performance, namely, if a decision result of "REVERSE" is "YES", the flow proceeds to step S409 in which the CPU 102 changes content of the reverse play status register to describe "true". Then, the CPU 102 reverts control to the main routine.

If the CPU 102 does not detect any one of the aforementioned changes of status such as stop, fast forward and reverse in step S406, namely, if a decision result of step S406 is "NO", the flow proceeds to step S404 in which the tempo of the automatic performance is set to the value which is updated by the panel process.

(e) Timer Interrupt Process

As described above, the CPU 102 sequentially executes the aforementioned processes, namely, the panel process of step S200, tone generation process of step S300 and automatic performance process of step S400 in a circulating manner. Herein, appropriate setting is made in response to manual operations on the aforementioned switches of the control panel 120 and/or sub panel 210, so that the electronic musical instrument produces musical tones in desired manners in response to striking operations being applied to the pads 201 and a hold operation being applied to the hold operator 300. The present embodiment also provides a timer interrupt process of FIG. 17 independently of the aforementioned routines. That is, the CPU 102 periodically executes the timer interrupt process every prescribed interval of time in response to a designated tempo, so that the electronic musical instrument plays automatic performance. It is described before that in the present embodiment, tempo information representing a preset tempo is included in the performance data in advance. Regardless of the preset tempo, it is possible for the user to arbitrarily change the tempo information by operating the tempo switches 128*d*, 128*u* of the control panel 120.

When the timer interrupt process is started, a flow firstly proceeds to step S501 in which a decision is made as to whether the electronic musical instrument is presently playing automatic performance or not. If the automatic performance is played, namely, if a decision result of step S501 is "YES", the flow proceeds to step S502 in which the CPU 102 sequentially reads performance data from the RAM 104 and instructs the sound source 105 to reproduce the performance data. In the case of the normal play of the automatic performance, the CPU 102 performs reading operations on the RAM 104 such that the performance data are sequentially and completely read out up to its end position. In the case of the reverse play of the automatic performance, the CPU 102 performs reading operations on the RAM 104 such that the performance data are reversely and completely read out up to its top position. If the CPU 102 has already described "true" in the reverse play status register (see step S409 shown in FIG. 16), the CPU 102 reversely reads out the performance data from the RAM 104 in a reverse order that is reverse to normal progression of notes of the performance data. Incidentally, it is possible to modify the present embodiment such that in the case of the fast forward play or reverse play, the CPU 102 merely updates a readout position on the performance data without instructing the sound source 105 to generate musical tone signals.

After completion of reproduction of the performance data in step S502 or if the CPU 102 determines in step S501 that the automatic performance is not played (namely, if a decision result of step S501 is "NO"), the CPU 102 ends the timer interrupt process to revert control to the main routine.

According to the present embodiment described heretofore, the electronic musical instrument is capable of playing automatic performance of musical tones as accompaniment of music play based on the performance data. In addition, the electronic musical instrument is capable of producing musical tones using tone colors, which are assigned to the operators in advance, in response to striking operations applied to the pads 201 of the pad operators 200 and a hold operation applied to the hold operator 300. Thus, even the inexperienced users such as children and aged persons are able to issue tone-generation instructions for generation of musical tone signals with ease.

By inserting a floppy disk recording performance data into the floppy disk drive 130, the main unit 100 of the electronic musical instrument reads in the performance data from the floppy disk to automatically perform assignment of tone colors to the operators respectively. This assists inexperienced users, who are inexperienced in playing musical instruments, to make desired setting for music play with ease.

The control panel 120 and sub panel 210 provide the users with prescribed control elements in reproduction such as start, stop, fast forward play and reverse play of automatic performance as well as prescribed control elements in generation of musical tones such as tone volume, tempo and modulation. So, the users are capable of setting and managing those control elements by merely operating switches of the control panel 120 and sub panel 210. Thus, every user is able to enjoy playing music in various manners.

[C] Modifications

This invention is not necessarily limited to the aforementioned embodiment, hence, it is possible to propose a variety of modifications on the electronic musical instrument, which will be described below.

(1) The present embodiment provides five operators in connection with the main unit 100. A number of the operators is not necessarily limited to five, hence, it is possible to provide an arbitrary number of the operators in connection with the main unit of the electronic musical instrument. In addition, it is possible to arbitrarily change combinations of the pad operators 200 and hold operator 300. That is, all the operators can be configured as hold operators being provided in connection with the main unit of the electronic musical instrument. Further, it is possible to apply to the hold operator 300 any types of pressure detectors for detection of manual operations that the user performs to issue tone-generation instructions. The pressure sensors are not necessarily limited to the aforementioned example shown in FIG. 6 in which a piezoelectric sensor is mounted on the base member. For example, it is possible to use distortion sensors to detect distorting operations or bending operations other than holding operations. If each of the operators has a capability of detecting multiple types of operations, it is possible to assign different tone colors to the multiple types of operations. In that case, the electronic musical instrument is designed to perform a tone generation process independently upon detection of each of the operations being applied to the operator.

Figure 18:
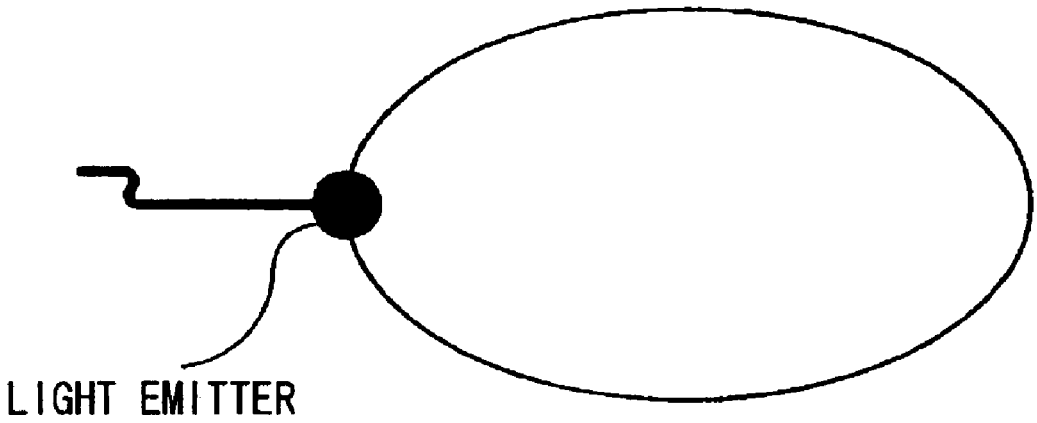
FIG. 18 is a plan view diagrammatically showing a modified example of the hold operator.
Figure 19:
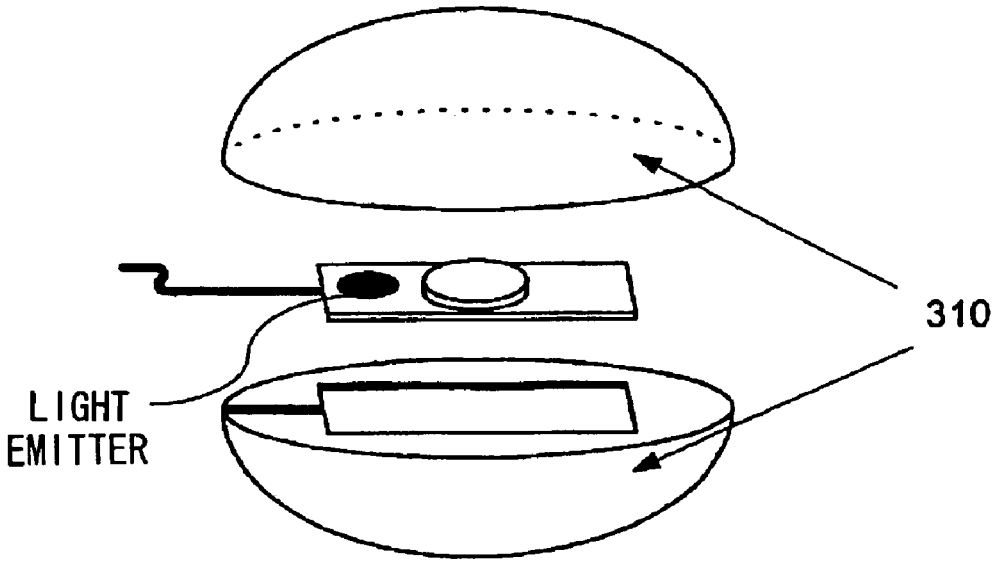
FIG. 19 is an exploded view showing another modified example of the hold operator.
Figure 20:
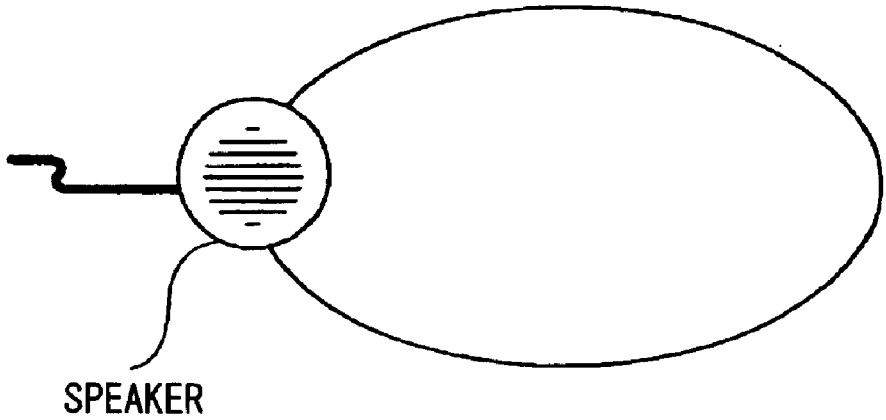
FIG. 20 is a plan view diagrammatically showing a modified example of the operator.
Figure 21:
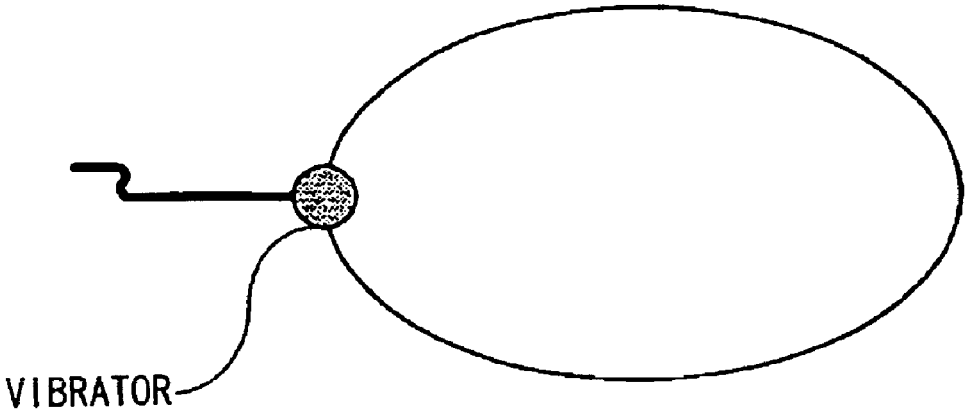
FIG. 21 is a plan view diagrammatically showing a further modified example of the hold operator.
Figure 22:
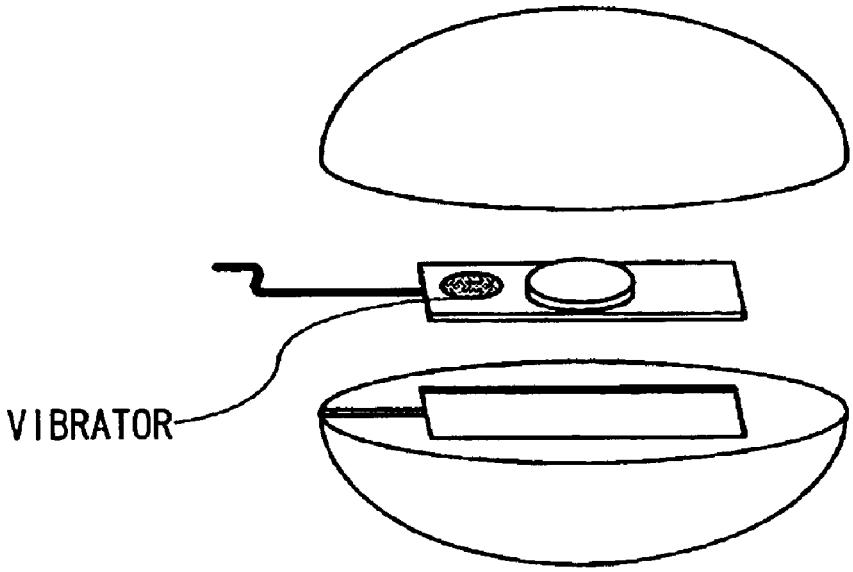
FIG. 22 is an exploded view showing a still further modified example of the hold operator.

(2) The present embodiment provides the main unit 100 with speakers 110 to notify the users of detection of tone-generation instructing operations being applied to the operators. It is possible to modify the hold operator 300 to have a light emitter such as a LED, which is lighted upon detection of a tone-generation instructing operation as shown in FIG. 18. Herein, the light emitter is not necessarily located at a prescribed position of the hold operator 300, so it can be arranged on a certain position of the main unit 100. In addition, it is possible to modify the hold operator 300 as shown in FIG. 19, wherein a hold member 310 is made by semitransparent material so that a light emitter is mounted on a base member 320 in proximity to a sensor. Notification of tone-generation instructing operations is not necessarily limited to radiation of light, so it can be realized by generation of sound or vibration, for example. That is, it is possible to modify the operator 200 as shown in FIG. 20, wherein a speaker is attached to a prescribed position of the operator 200 to produce sound. In addition, it is possible to modify the hold operator 300 as shown in FIG. 21, wherein a vibrator is attached to a prescribed position of the hold operator. Further, it is possible to modify the hold operator 300 as shown in FIG. 22, wherein a vibrator is mounted on the base member in proximity to the sensor within the hold member. Thus, the vibrator generates vibration upon detection of tone-generation instructing operations being applied to the operator. Anyway, by providing any types of tools or components for notifying detection of tone-generation instructing operations such as striking operations, the users are able to monitor tone-generation instructions being issued by themselves. Thus, it is possible to improve performability in music play.

(3) The light emitter shown in FIG. 18 or 19 can be used for indications of striking timings at which users are required to strike pads of the operators in musical performance. In this case, the performance data include data of a user's part with regard to each of tone colors being assigned to the pad operators 200 and hold operator 300. In the timer interrupt process, the data of the user's part corresponding to the tone color assigned to the operator are read out together with data of an accompaniment part for use in automatic performance. Thus, the data of the user's part are used to designate timings of radiating light from the light emitter. In this case, it is possible to perform various timing controls on the light emitter to radiate light. For example, it is possible to control the light emitter to radiate light at a timing which is slightly earlier than an accurate striking timing at which a striking operation should be actually applied to the pad of the operator 200. Or, it is possible to control the light emitter to flash light at a timing which is prior to the accurate striking timing by a prescribed time. Further, it is possible to provide various combinations of colors and intensities of light being radiated by light emitters. In other words, it is possible to change light radiation of the light emitter in color and intensity in response to various conditions, which correspond to indication of detection of striking operations, indication of striking timings and indication of errors of striking timings, for example. The aforementioned notification of the striking timings can be realized by the speaker shown in FIG. 20 as well as the vibrators shown in FIGS. 21 and 22. Or, it is possible to provide desired combinations of the aforementioned tools or components used for notification.

(4) The present embodiment describes such that the performance data are configured by MIDI data. Of course, it is possible to describe the performance data in other formats other than the MIDI format. In addition, external storage media for storing performance data are not necessarily limited to floppy disks, so it is possible to use other storage media such as CD-ROM, MD, etc. Or, it is possible to download the performance data from the server by way of the communication network.

(5) In the electronic musical instrument of the present embodiment, when a floppy disk is newly inserted into the floppy disk drive, automatic performance is stopped so that the main unit automatically loads new performance data from the floppy disk and proceeds to assignment of tone colors to the operators. Herein, it is possible to provide a switch or else for entry of a command to load performance data from the floppy disk. So, the main unit is designed to load the performance data only when the user operates such a performance data load switch.

(6) The present embodiment describes such that a single floppy disk records performance data with respect to a single musical tune. Of course, it is possible to configure a single floppy disk to record performance data and tone color data with respect to plural musical tunes. In this case, the electronic musical instrument has a function for allowing the user to designate a musical tune whose data are to be read in within the plural musical tunes. Or, the electronic musical instrument has a function to read in all data of all musical tunes to the main unit from the floppy disk so that the user designates from among the musical tunes a single musical tune to start its automatic performance.

(7) The present embodiment provides the control panel (and/or sub panel) to control various elements in music play such as stop, play, fast forward and rewind of automatic performance as well as tone volume, tempo and modulation in generation of musical tones. Other than the aforementioned elements, it is possible to control selection and assignment of tone colors as well as characteristics of sensors, for example.

(8) The present embodiment provides only a single operator 200-0 with the sub panel 210 for entry of commands regarding generation of musical tones being played back. Of course, it is possible to provide each of plural operators with the sub panel. In addition, the sub panel 210 is not necessarily designed to have a limited number of switches within all switches of the control panel 120. That is, it is possible to modify the sub panel 210 to have all switches of the control panel 120. Or, it is possible to modify the sub panel 210 to have other switches whose functions differ from functions of the switches of the control panel 120.

(9) The electronic musical instrument of the present embodiment can be modified such that the main unit localizes sound in response to a connected position of the operator being operated by the user. Or, it can be modified such that the speaker increases sound in tone volume when its corresponding operator is operated by the user. Further, it is possible to additionally provide the electronic musical instrument with a sensor or detector that detects a positional relationship between the main unit 100 and each of the operators 200 and 300. In this case, sound is to be localized in a direction in which the operator is located to depart from the main unit 100.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A musical tone signal generation apparatus accommodated for multiple users to play music in an ensemble, comprising:

a main unit;

a plurality of performance operators, each of which is physically separated from the main unit and is manually operated by each user to issue tone-generation instructions, wherein at least one of the plurality of performance operators is configured as a hold operator that is configured using a pressure sensor mounted on a base member and encapsulated in a hold member which is made by elastic material and is formed in around shape suited for grip of the user;

a storage medium for storing performance data and tone color data with respect to at least a single musical tune constructed by a plurality of parts respectively corresponding to a plurality of tone colors;

a tone color assignor for assigning the plurality of tone colors to the plurality of performance operators;

a musical tone signal generator for generating musical tone signals based on the performance data stored in the storage medium so as to play automatic performance or for generating musical tone signals in response to the tone-generation instructions being issued from each of the plurality of performance operators so as to play manual performance using each of the tone colors assigned to the performance operators; and a plurality of speakers for producing musical tones corresponding to the musical tone signals of the automatic performance or manual performance, wherein the plurality of speakers are arranged on the main unit in connection with the plurality of performance operators respectively.

2. A musical tone signal generation apparatus according to claim 1 wherein the musical tone signal generator generates musical tone signals in response to pressure being detected by the pressure sensor of the hold operator.

3. A musical tone signal generation apparatus according to claim 1 wherein the musical tone signal generator generates musical tone signals in response to differential values calculated from pressure being detected by the pressure sensor of the hold operator.

4. A musical tone signal generation apparatus according to claim 1 wherein each of the plurality of performance operators except the hold operator installs at least a pad whose surface is to be struck by each user to issue a tone-generation instruction.

5. A musical tone signal generation apparatus according to claim 1 further comprising a control panel that is mounted on the main unit to provide manual controls for the automatic performance and the manual performance.

6. A musical tone signal generation apparatus according to claim 5 further comprising a sub panel that is mounted on the performance operator to provide manual controls for the automatic performance.

7. A musical tone signal generation apparatus according to claim 1 wherein each of the plurality of performance operators further installs an informer that informs the user of issuance of a tone-generation instruction.

8. A musical tone signal generation apparatus according to claim 7 wherein the informer is a speaker that produces sound in response to issuance of a tone-generation instruction.

9. A musical tone signal generation apparatus according to claim 7 wherein the informer is a light emitter that radiates light in response to issuance of a tone-generation instruction.

* * * * *